US005581278A

United States Patent [19]

Sugai et al.

[11] Patent Number: 5,581,278

[45] Date of Patent: Dec. 3, 1996

[54] IMAGE DISPLAY CONTROL SYSTEM

[75] Inventors: Kazuo Sugai, Yokohama; Hisaaki Shibata, Ebina; Kazuko Ito, Yokohama; Ken Watanabe, Fujisawa; Katsuyoshi Onishi, Yokohama, all of Japan

[73] Assignee: Hitachi, Ltd., Tokyo, Japan

[21] Appl. No.: 890,270

[22] Filed: May 29, 1992

[30] Foreign Application Priority Data

May 29, 1991 [JP] Japan ..... 3-126133

[51] Int. Cl.[6] ..... G09G 3/00

[52] U.S. Cl. ..... 345/187; 345/213

[58] Field of Search ..... 340/814, 799, 340/798, 703, 717, 721, 723, 745; 345/213, 186, 187, 189, 201, 200, 1, 2; 358/149, 183

[56] References Cited

U.S. PATENT DOCUMENTS

| | | | |
|---|---|---|---|
| 4,800,431 | 1/1989 | Deering | 358/160 |
| 4,882,710 | 11/1989 | Hashimoto et al. | 340/799 |
| 4,904,990 | 2/1990 | Takeda et al. | 340/814 |
| 4,933,879 | 6/1990 | Ando et al. | 345/187 |
| 4,999,620 | 3/1991 | Ishii | 340/798 |
| 5,021,775 | 6/1991 | Babin | 340/814 |

*Primary Examiner*—Tommy P. Chin
*Assistant Examiner*—A. Au
*Attorney, Agent, or Firm*—Antonelli, Terry, Stout & Kraus

[57] ABSTRACT

A display control system provided between a computer and a display device includes a plurality of display control LSI's for data transfer and also displays image data stored in a plurality of image memories having planes on the display device by controlling plane groups which include one or more planes. Each display control LSI includes an enable generator for generating a synchronization enabling signal in accordance with LSI designation information and an input/output buffer for outputting a synchronization signal in response to the enabling signal. A synchronization signal from one of the plurality of display control LSI's designated by the LSI designation information is supplied to the plurality of display control LSI's inclusive of the designated display control LSI through a signal line to allow the plurality of display control LSI's to operate with each other, thereby making it possible to produce and display data to be simultaneously on the display device.

9 Claims, 8 Drawing Sheets

IMAGE DISPLAY CONTROL SYSTEM

BACKGROUND OF THE INVENTION

The present invention relates to an image display control system for displaying image data stored in a plurality of image memories having planes on a display device, the image display control system having a plurality of display controllers for controlling plane groups, each of which includes one or more planes.

One example of the conventional display control system is shown in FIG. 1.

In FIG. 1, reference numeral 1 designates an image bus for data transfer between a display control LSI 20 and a computer system body (not shown). An image memory 30 is connected to the display control LSI 20. Numeral 4 designates a color look-up table by which values read from the individual planes of the image memory 30 corresponding to each pixel are converted into a color for that pixel. The result of a search of the table 4 for the values for each pixel is output to a display device 5. In the present example, the image memory 30 is constructed by a dual-port image memory.

The display control LSI 20 includes an image bus interface (I/F) unit 100 for controlling an interface relative to the image bus 1, a display device control unit 102 for controlling the display device 5, a refresh activation unit 105 for periodically activating the refreshment of the dual-port image memory 30 in order to preserve the storage contents of the dual-port image memory 30, and an image memory I/F unit 104 for mediating between a read transfer request 112 from the display device control unit 102 and a refresh request 114 from the refresh activation unit 105 to cause a cycle of the dual-port image memory 30. In the case where the image memory is constructed by an ordinary static or dynamic memory, the read transfer request 112 is replaced by a data read request.

The display device control unit 102 generates a horizontal sync signal 120, a vertical sync signal 121 and a display period signal 122 which make the control of the display device 5. The controller 102 further generates the read transfer request 112 and serial clocks.

The display control LSI 20 receives a clock signal 6 (hereinafter referred to as a display clock signal) which provides the basis for the timing of control of the display device 5 and a clock signal 7 (hereinafter referred to as an image clock signal) which provides the basis of the timing of control of the dual-port image memory 30. A signal, from which the read transfer request 112 originates, is generated on the basis of the display clock signal 6. However, it is required that the read transfer request 112 is synchronous with a clock signal for operating the image memory I/F unit 104 (or the image clock signal 7). Therefore, in the case where the display clock signal 6 and the image clock signal 7 are asynchronous, the signal, from which the read transfer request 112 originates, is synchronized with the image clock signal 7 in the display device control unit 102.

As an example of a display control system, in which a display control including the above-mentioned signal synchronization is made having an asynchronous display clock signal and image clock signal, one can refer to JP-A-63-148292 which discloses an image memory access system.

The above conventional display control system fills its function with no problem in the case where the system has only one display control LSI. However, this prior art reference does not cope with the case where the system has a plurality of display control LSI's which should be operated in synchronism with each other to produce data to be simultaneously displayed on one display device. Especially, in the case where display and image clock signals are asynchronous, there is a problem that since the synchronization is independently made in each display control LSI, the timing of a signal after synchronization deviates between the display control LSI's to be provided corresponding to plane groups each of which includes one or more planes.

If it is possible to provide a display control system which has a plurality of display control LSI's for individual plane groups and makes it possible to synchronize the display control LSI's with each other to produce data to be simultaneously displayed on one display device even in the case where a display clock signal and an image clock signal are asynchronous, an increase in display colors by increasing the number of bits forming one pixel can be achieved by merely increasing the number of planes and the addition of a display control LSI('s) which controls the added plane(s).

In such a case, if the display control LSI to be added can be provided with the same construction as the display control LSI's having already possessed by the system, the efficiency of fabrication can be improved since the fabrication of one kind of LSI suffices.

SUMMARY OF THE INVENTION

An object of the present invention directed to a display control system which displays image data stored in a plurality of image memories having planes on a display unit and has a plurality of display controllers for controlling plane groups each including one or more planes, is to provide a display control system which can operate all the display controllers in synchronism with one another to produce data to be simultaneously displayed on one display device. A specific object of the present invention is to provide a display control system which is capable of synchronizing all display controllers with one another to produce multi-color data to be simultaneously displayed on one display device even in the case where a display clock signal and an image clock signal are asynchronous.

Another object of the present invention is to provide a display control system in which the number of bits forming one pixel can be changed by merely changing the number of display controllers without changing the construction of the display controller.

To attain the above object, in an image display control system according to one aspect of the present invention, each of a plurality of display control means for controlling a plurality of plane groups includes distinction designating means for distinguishing one of the plurality of the display control means from the others and sync signal supplying means for supplying one or more kinds of sync signals to all the display control means, inclusive of the distinguished display control means, when that display control means itself is distinguished by the distinction designating means, thereby operating the plurality of display control means in synchronism with each other.

More particularly, each of a plurality of display control LSI's includes one or more input/output pins to/from which one or more kinds of sync signals (hereinafter referred to as inter-LSI sync signals) for obtaining synchronization between the plurality of display control LSI's are input/output, and one or more input pins to which information indicative of the distinction of one of the plurality of display control LSI's from the others is input, the input/output pins of the plurality of display control LSI's being connected by signal lines so that corresponding ones of the input/output pins of the plurality of display control LSI's, to/from which the same kind of inter-LSI sync signal is to be input/output, are interconnected. One display control LSI set by the information indicative of the distinction to be distinguished from the other display control LSI's enables an inter-LSI sync signal, and the enabled inter-LSI sync signal is input to all the display control LSI's inclusive of the one display control LSI distinguished from the others so that it is used by all the display control LSI's.

For example, in the case where an image memory is constructed by a dual-port image memory, the inter-LSI sync signal includes a frame sync signal for bringing a control condition of a display device into a condition at the lead of a frame, a read transfer sync signal for providing the basis of the timing of generation of the cycle of transfer from a random access memory of the dual-port image memory to a serial access memory thereof, and a refresh sync signal for providing the basis of the timing of generation of a refresh cycle of the dual-port image memory.

In the case where the image memory is constructed by a dynamic memory, the inter-LSI sync signal includes a frame sync signal for bringing a control condition of the display device into a condition at the lead of a frame, a data read sync signal for providing the basis of the timing of reading of data from an ordinary port of the dynamic memory, and a refresh sync signal for providing the basis of the timing of generation of a refresh cycle of the dynamic memory.

In the case where the image memory is constructed by a static memory, the inter-LSI sync signal includes a frame sync signal for bringing a control condition of the display device into a condition at the lead of a frame and a data read sync signal for providing the basis of the timing of reading of data from an ordinary port of the static memory.

The frame sync signal is generated by producing a logical sum of an inverted version of a signal which is input from the body of a computer connected to the display control system and provides the basis of the timing of activation of the control of the display device and a signal which indicates one clock period of the final frame of the display device. If the image memory is constructed by a dual-port image memory and a display clock signal and an image clock signal are asynchronous, since the signal providing the basis of the timing of activation of the control of the display device is input from the computer body in synchronism with the image clock, this signal is synchronized with the display clock signal, and then used as an input to the logical sum means to produce the frame sync signal.

Also, a signal, from which the read transfer sync signal originates, is synchronized with the image clock signal since the read transfer sync signal is otherwise synchronous with the display clock signal.

Since only the one display control LSI distinguished from the other display control LSI's enables an inter-LSI sync signal and the enabled inter-LSI sync signal is used by all the display control LSI's inclusive of the enabling display control LSI, all the display control LSI's operate in synchronism with the inter-LSI sync signal. Thereby, display data produced by the individual display control LSI's can be displayed simultaneously on one display device.

Further, in the present invention, only the one display control LSI distinguished from other display control LSI's enables an inter-LSI sync signal and the other display control LSI's only receive and use the enabled inter-LSI sync signal. Therefore, the one display control LSI distinguished from the other display control LSI's is not affected by whether or not the other LSI's are connected to the distinguished LSI. Accordingly, no restriction is imposed on the number of display control LSI's which form the display control system. Thereby, a display control system, in which the number of bits forming one pixel is variable, can be provided without changing the construction of the display control LSI.

In the case where the image memory is constructed by a dual-port image memory, the value of a counter for generating a timing for a vertical direction of the display device can be used in each display control LSI to obtain an address for transfer from a random access memory of the dual-port image memory to a serial access memory thereof. Thereby, it is possible to reduce the amount of logic.

In the case where the image memory is constructed by a static or dynamic memory, the value of a counter for generating timing for a vertical direction of the display device and the value of a counter for generating timing for a horizontal direction of the display device can be used in each display control LSI to obtain a read address for displaying data written in the static or dynamic memory, thereby making it possible to reduce the amount of logic. In this case, it is required that the display clock signal and the image clock signal are synchronous with each other.

DESCRIPTION OF THE PREFERRED EMBODIMENTS

Embodiments of the present invention will now be explained in reference to the accompanying drawings.

Figure 1:
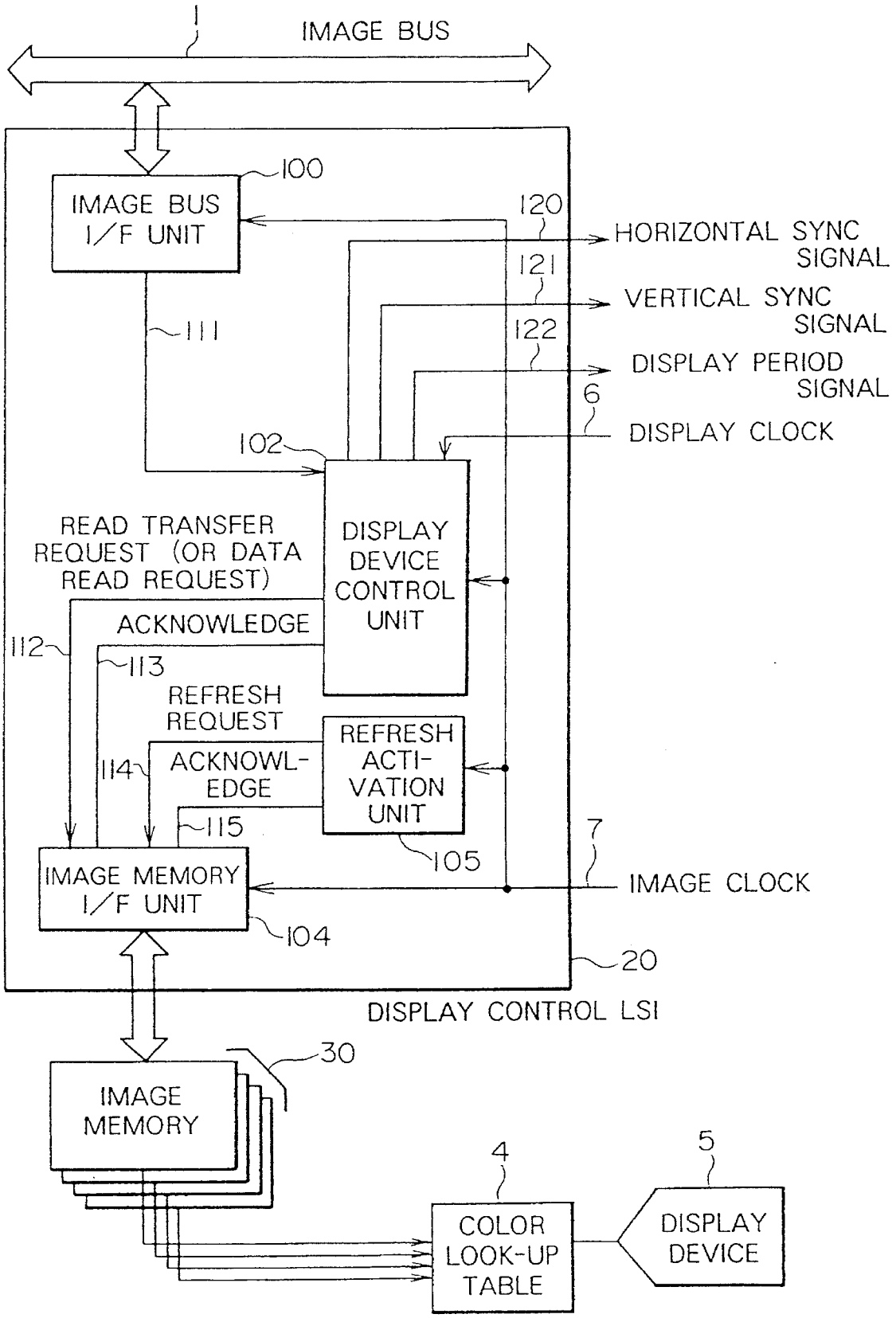
FIG. 1 PRIOR ART
FIG. 1 is a block diagram showing an example of the construction of the conventional display control system.
Figure 2:
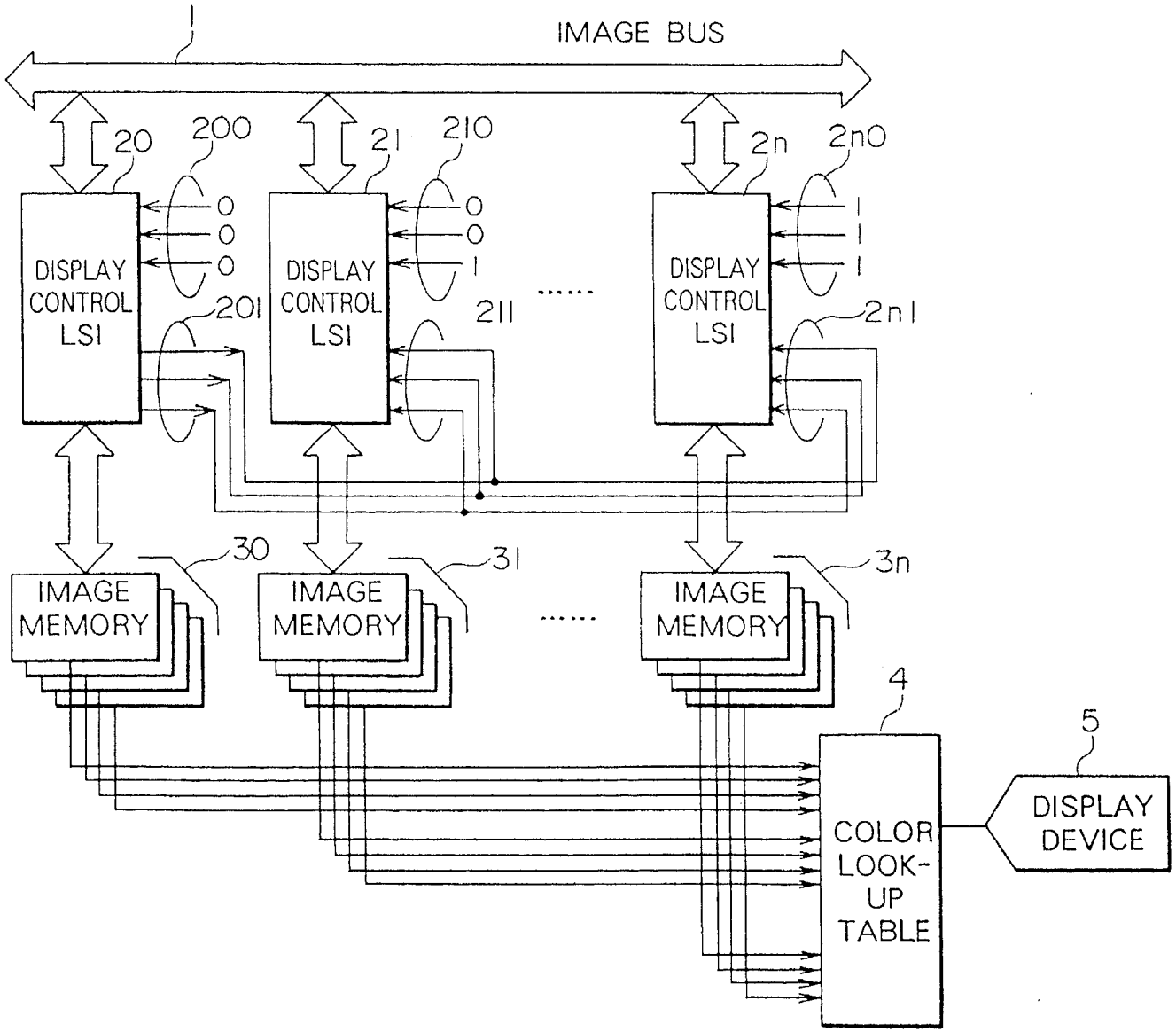
FIG. 2 is a block diagram showing the construction of an image display board according to an embodiment of the present invention.

FIG. 2 shows a block diagram of the construction of an image display board according to an embodiment of the present invention.

In FIG. 2, reference numeral 1 designates an image bus to which a plurality of display control LSI's 20, 21, . . . and **2*n* are connected. Image memories 30, 31, . . . and 3*n* having the same storage capacity are connected to the display control LSI's 20, 21, . . . and 2*n***, respectively.

Each of the image memories 30, 31, . . . and 3*n* includes one or more the planes. One of individual bits of each plane corresponds to one pixel on a display device 5 and the plurality of planes correspond to the same position on the display device 5. Namely, since bits, in number equal to the planes, correspond to one pixel, it is possible to display colors in number equal to the n-th power of 2 where n is the number of planes. Since all of the plurality of planes connected to the plurality of display control LSI's correspond to the same position on an image, the number of colors capable of being displayed can be increased by increasing the number of display control LSI's.

Each of the display control LSI's 20, 21, . . . and 2*n* is provided with input pins 200, 210, . . . or 2n0 for identifying an LSI number of that display control LSI (hereinafter referred to as ID information) so that different values are set for the display control LSI's 20, 21, . . . and 2*n*, respectively. In FIG. 2, since three input pins 200, 210, . . . or 2n0 are provided for each of the display control LSI's, it is possible to provide 8 display control LSI's at the most.

The number of input pins 200, 210, . . . or 2n0 may be one for each of the display control LSI's 20, 21, and 2*n*. In such a case, one of the display control LSI's 20, 21, . . . and 2*n* is set with a value different from a value to be set for the other display control LSI's to distinguish the one display control LSI from the others. When one specified display control LSI is beforehand designated, the number of other display control LSI's capable of being provided may be arbitrary.

The display control LSI's 20, 21, . . . and 2*n* are provided with input/output pins 201, 211, . . . and 2n1 in order to operate the display control LSI's in synchronism with one another. The input/output pins are connected by signal lines, and the input/output pins 201, 211, . . . and 2n1 are all constructed by input/output buffers. Thereby, only a specified display control LSI, for example, the 0th display control LSI (or one display control LSI distinguished from the other display control LSI's) enables a signal line connected to its own input/output pin so that all the display control LSI's inclusive of the enabling display control LSI 20 are operated by a signal inputted from their input/output pins (hereinafter referred to as an inter-LSI sync signal). With such a construction, all the display control LSI's 20, 21, ---, and 2*n* can be synchronized with each other by the same signal. One or more input/output pins 201, 211, . . . or 2n1 may be provided for one display control LSI.

In order to display the contents of the image memories 30, 31, . . . and 3*n* on the display device 5, the contents of the image memories are read in synchronism with the display device 5 or the image memory is constructed by a dual-port image memory so that display data is read from the serial port side of the memory. FIG. 2 shows an example in which the image memory is constructed by a dual-port image memory.

Next, the construction of the display control LSI 20, 21, . . . or 2*n* will be explained in reference to FIG. 3. The display control LSI's 20, 21, . . . and 2*n* have the same construction.

Figure 3:
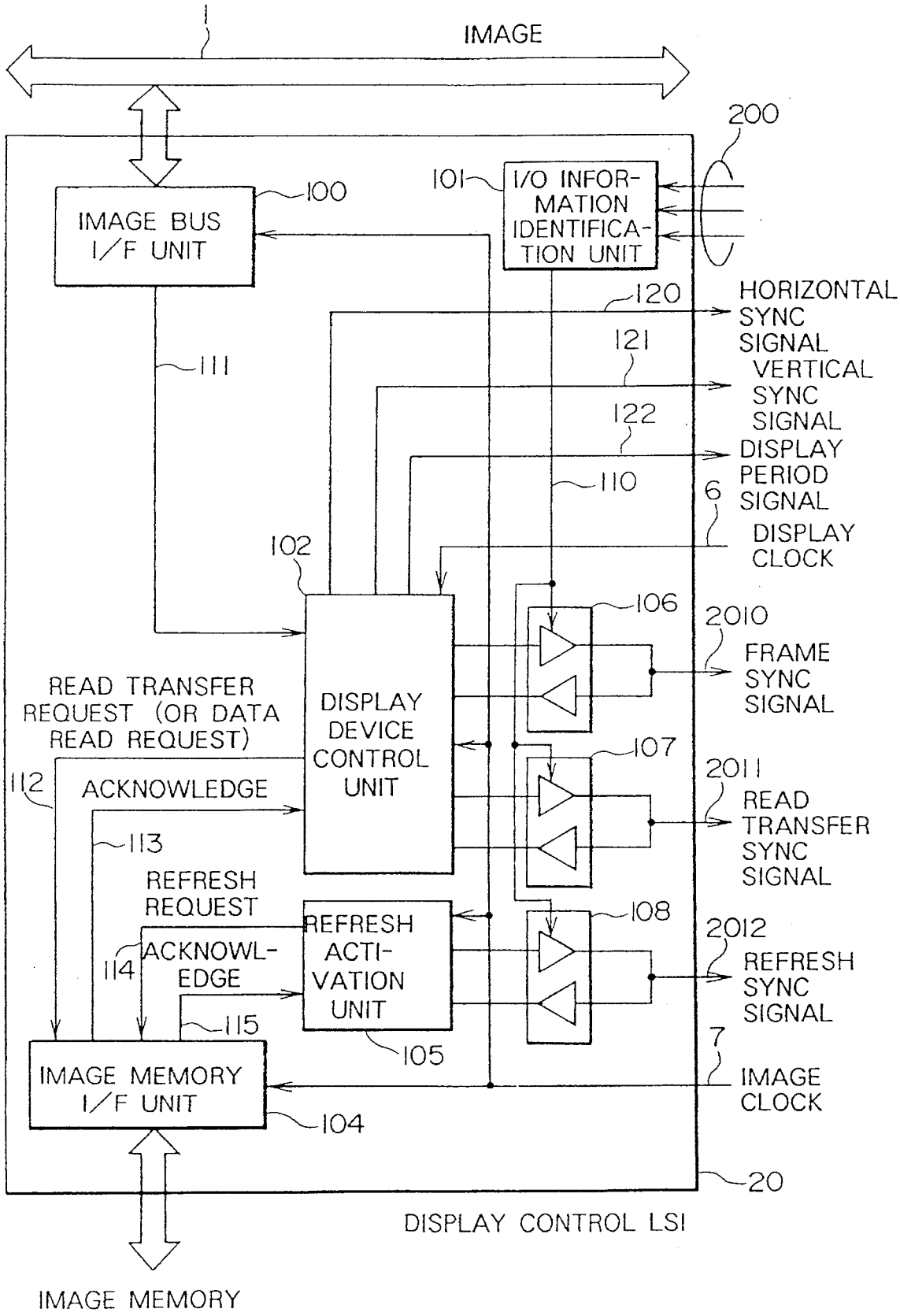
FIG. 3 is a circuit diagram showing the construction of a display control LSI.

In FIG. 3, reference numeral 100 designates an image bus interface (I/F) unit for controlling an interface relative to an image bus 1, numeral 101 an I/D information identification unit for identifying I/D information, numeral 102 a display device control unit for making the control of a display device 5, numeral 104 an image memory I/F unit for controlling an interface relative to an image memory, and numeral 105 a refresh activation unit for activating the refreshment of the image memory.

In order to operate the display device control unit 102 of the display control LSI 20 under consideration in synchronism with the display device control units 102 of the other display control LSI's, there are provided buffers 106 and 107 which input/output a signal 2010 (hereinafter referred to as a frame sync signal) for making frame synchronization and a signal 2011 (hereinafter referred to as a read transfer sync signal) for making the synchronization of read transfer or transfer of display data from a random access memory of the dual-port image memory to a serial access memory thereof, respectively.

Numeral 108 designates a buffer for inputting/outputting a sync signal 2012 (hereinafter referred to as a refresh sync signal) for operating the refresh activation unit 105 of the display control LSI under consideration in synchronism with the refresh activation units 105 of the other display control LSI's.

In FIG. 3, the inter-LSI sync signal collectively shown in FIG. 2 is shown in a divided form which includes the individual signals 2010, 2011 and 2012.

When the image memory is constructed by a static memory, the refresh activation unit 105 and the input/output buffer 108 are no longer necessary.

The I/D information identification unit 101 asserts a signal 110 for enabling the inter-LSI sync signals 2010, 2011 and 2012 if the display control LSI, in which that I/D information identification unit 101 is included, is the 0th display control LSI (or one display control LSI distinguished from the other display control LSI's). The signal 110 will hereinafter be referred to as a 0th-LSI signal.

The display device control unit 102 generates a horizontal sync signal 120, a vertical sync signal 121 and a display period signal 122 which control the display device 5. In the case where the image memory is constructed by a dual-port image memory, the display device control unit 102 makes the activation of a read transfer cycle and the generation of serial clocks. On the other hand, in the case where the image memory is constructed by an ordinary dynamic or static memory, the display device control unit 102 activates the cycle of reading display data from an ordinary port of the ordinary dynamic or static memory in a manner timed with a display period.

The image memory I/F unit 104 mediates between a read transfer request 112 from the display device control unit 102 and a refresh request 114 from the refresh activation unit 105 to cause the cycle of the image memory.

In the present embodiment, the display device control unit 102 is operated by a display clock signal 6 and the other units are operated by the image clock signal 7 asynchronous with the display clock signal 6, in order that the application of the display control LSI to systems including various clock signals for various display devices (or display clock signals 6), for example, both a system having a CRT display as the display device 5 and a system having a liquid crystal display as the display device 5, becomes possible without changing clocks of the body of a computer system (or the image clock signal 7). Those portions of the display device control unit 102, which receive or send signals from or to parts other than the display control unit 102, use the image clock signal 7 as well as the display clock signal 6. When the image memory is constructed by a dual-port image memory, the present embodiment can cope with the case where the display clock signal 6 is asynchronous with the image clock signal 7. When the image memory is constructed by an ordinary dynamic or static memory, it is required that the display clock signal 6 be synchronous with the image clock signal 7, for a reason which will be mentioned later on.

Next, the construction of the display device control unit 102 will be explained in reference to FIG. 4.

The setting of parameters for making the control of the display device 5 and the control of start/stop of a display operation are made by setting values from the image bus into a register. The parameters for controlling the display device 5 include lateral and longitudinal (or horizontal and vertical) display periods (HD, VD), a horizontal sync signal assertion period (HS), a horizontal back porch (HB) and a horizontal front porch (HF) indicative of an interval between the horizontal sync signal assertion period (HS) and a horizontal display period (HD), and a vertical back porch (VB) and a vertical front porch (VF) indicative of an interval between a vertical sync signal assertion period (VS) and a vertical display period (VD). It does not necessarily follow that the values to be set into the register are the above parameters themselves. For example, in the case where counters are respectively provided for generating timings for horizontal and vertical signals so that the timings are generated from the count values of those counters, there may be considered a method in which the count values at those timings are set in the register.

A plurality of display control LSI's are connected to the image bus, and the corresponding registers of those display control LSI's are mapped at the same address so that the simultaneous write into the corresponding registers is made by the write to the same address.

Figure 4:
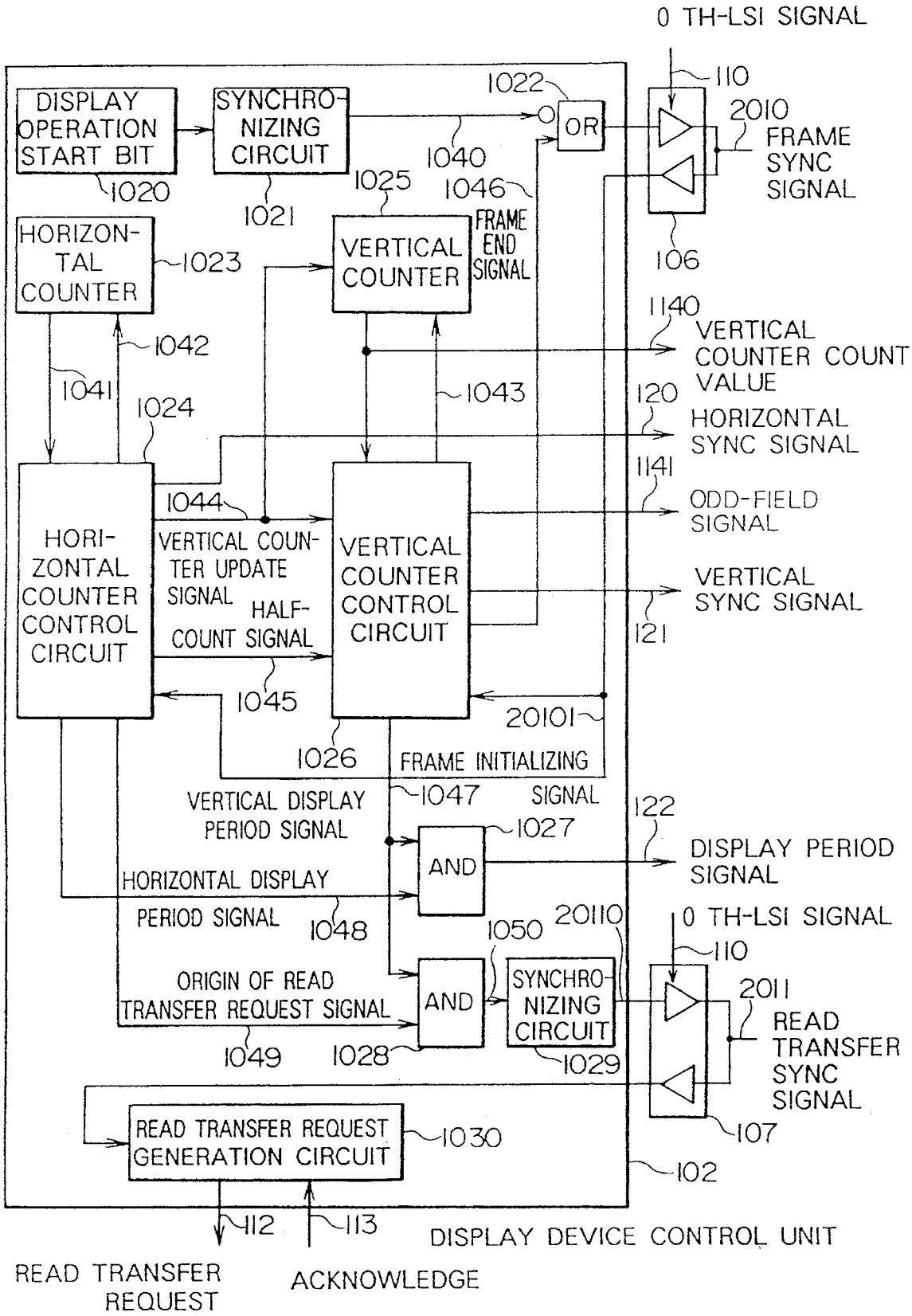
FIG. 4 is a circuit diagram showing the construction of a display device control unit.

In FIG. 4, reference numeral 1020 designates a display operation start bit. The display operation start bit corresponds to one bit of one register of the display control LSI. The start bit 1020 is enabled by writing "1" from the image bus into the corresponding bit of this register. A write path for the display operation start bit is not shown in FIG. 4.

In the case where the display clock signal 6 and the image clock signal 7 are asynchronous, a signal obtained by synchronizing the start bit 1020 with the display clock signal 6 by a synchronizing circuit 1021 is used as a signal 1040 for activation of the display device control unit 102. This is because it is necessary to operate the display device control unit 102 by the display clock signal 6 and it is required that a control signal for start/stop of circuits included in the display device control unit changes in synchronism with the display clock signal 6. In the case where the display clock signal 6 and the image clock signal 7 are synchronous with each other, the synchronizing circuit 1021 is not necessary.

Numeral 1023 designates a horizontal counter for generating timings for a horizontal sync signal 120 and a horizontal display period signal 1048, and numeral 1024 designates a horizontal counter control circuit for controlling the horizontal counter 1023 and producing from the values of the horizontal counter 1023 the horizontal sync signal 120, the horizontal display period signal 1048, a half-count signal 1045 indicating that the value of the horizontal counter 1023 is a half of the full count value, a vertical counter update signal 1044, and a signal 1049 from which a read transfer request signal originates. The half-count signal 1045 is used when a display device of an interface system is to be controlled.

Numeral 1025 designates a vertical counter for generating timings for a vertical sync signal 121 and a vertical display period signal 1047, and numeral 1026 designates a vertical counter control circuit for controlling the vertical counter 1025 and producing from the values of the vertical counter 1025 the vertical sync signal 121, the vertical display period signal 1047, an odd field signal 1141 indicating that the present field is an odd-numbered field, and a frame end signal 1046 for returning the whole of the display device control unit to a condition at the lead of a frame. The odd field signal 1141 is used when a display device of an interlace system is to be controlled.

The horizontal counter 1023 starts from 0 and counts up in increments of one each time the display clock 6 is input. The horizontal counter 1023 is returned to 0 by a horizontal counter clear signal 1042 output from the horizontal counter control circuit 1024. Alternatively, the horizontal counter 1023 may be constructed such that after an initial value of the horizontal counter 1023 has been set by a horizontal counter initializing signal output from the horizontal counter control circuit 1024, the horizontal counter 1023 is counted down by increments of one each time the display clock 6 is input and is returned to the initial value when the count value reaches 0.

The vertical counter 1025 is counted up by increments of one each time the vertical counter update signal 1044 is asserted. The vertical counter 1025 is returned to 0 by a vertical counter clear signal 1043 output from the vertical counter control circuit 1026. For a reason as will be mentioned later on, the vertical counter 1025 does not take a down counter construction. For the display device control unit 102 having the above construction can be used, for example, Type "HD63484" advanced CRT controller sold by the assignee of the present application.

Next, methods for controlling the horizontal counter 1023 will be explained comparatively from the aspects of the amount of logic and the simplicity of control in the hardware. The explanation will be made by reference to FIG. 5.

Figure 5:
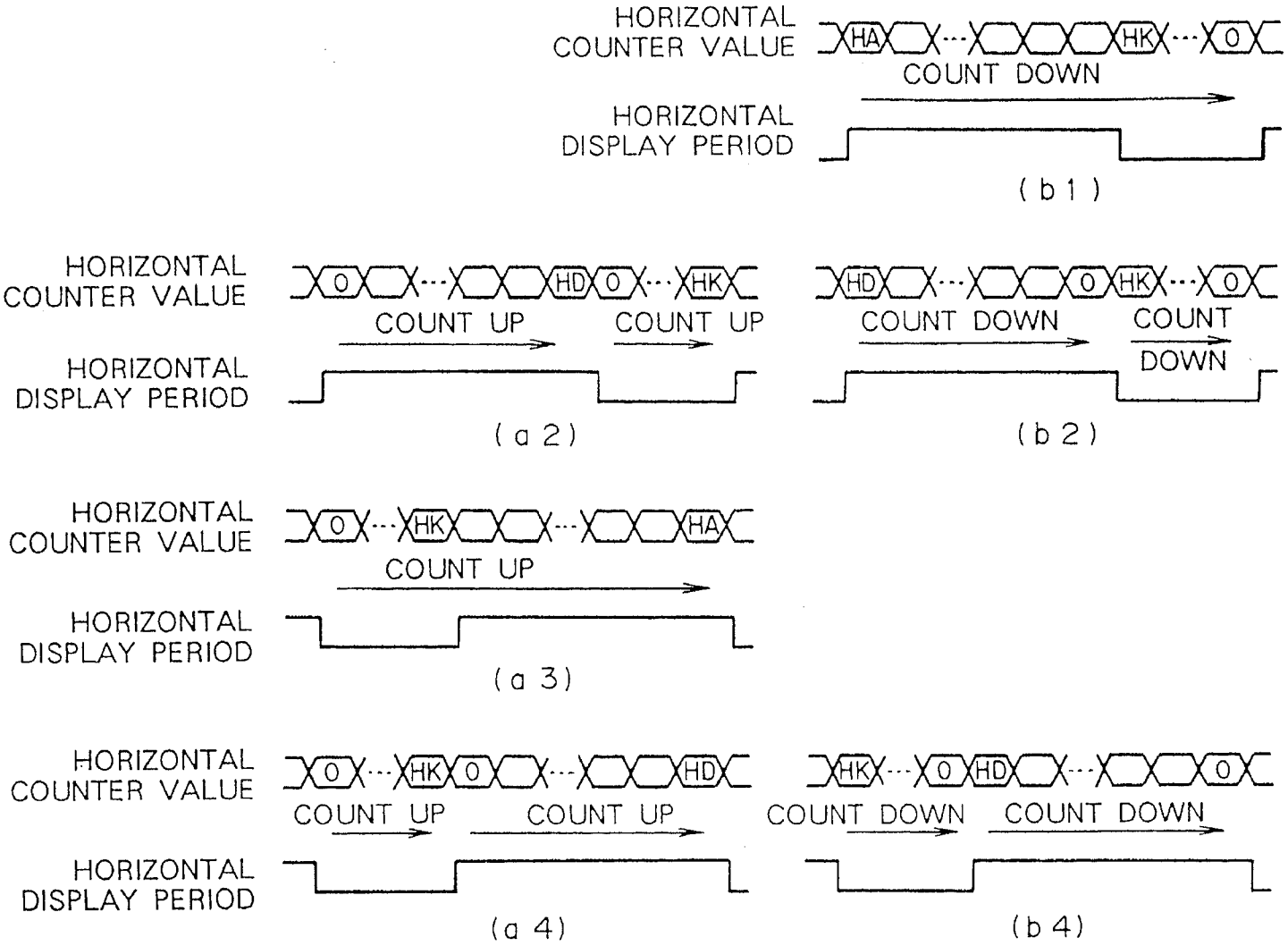
FIG. 5 shows timing charts for explaining methods for controlling of a horizontal counter.

In FIG. 5, reference symbol HA designates a count value corresponding to a total or entire horizontal period, symbol HD a count value corresponding to a horizontal display period, and symbol HK a count value corresponding to a horizontal blanking period or non-display period.

In FIG. 5, an operating waveform (a2), (a3) or (a4) shows an example in which the horizontal counter 1023 is constructed by an up counter, and an operating waveform (b1), (b2) or (b4) shows an example in which the horizontal counter 1023 is constructed by a down counter. The waveform (a2), (b1) or (b2) corresponds to an example of the prior art in which the display period is followed by the non-display period, and the waveform (a3), (a4) or (b4) corresponds to an example according to the present invention in which the non-display period is followed by the display period. The waveform (a3) or (b1) shows an example in which the horizontal counter 1023 is counted up or down only one time in one horizontal period (1H), and the waveform (a2), (b2), (a4) or (b4) shows an example in which the horizontal counter 1023 is counted up or down in each of the display period and the non-display period.

The image memory is constructed by an ordinary dynamic or static memory and hence it is necessary to read display data from an ordinary data input/output port in a display period. The control method shown by the waveform (a2) or (a4) can be employed to use the value 1041 of the horizontal counter as a part of an address for reading the display data since the value 1041 of the horizontal counter takes 0 at the lead of the horizontal display period and is incremented during the horizontal display period.

In the case where the image memory is constructed by a dual-port image memory, any control method shown in FIG. 5 can be used since it is only necessary to cause a read transfer cycle by designating a read address at the beginning of one horizontal display period and an address in the course of a line is not required.

Next, one example of a method for generating the horizontal sync signal 120 and the horizontal display period signal 1048 from the value 1041 of the horizontal counter 1023 will be explained by reference to FIG. 6.

Figure 6:
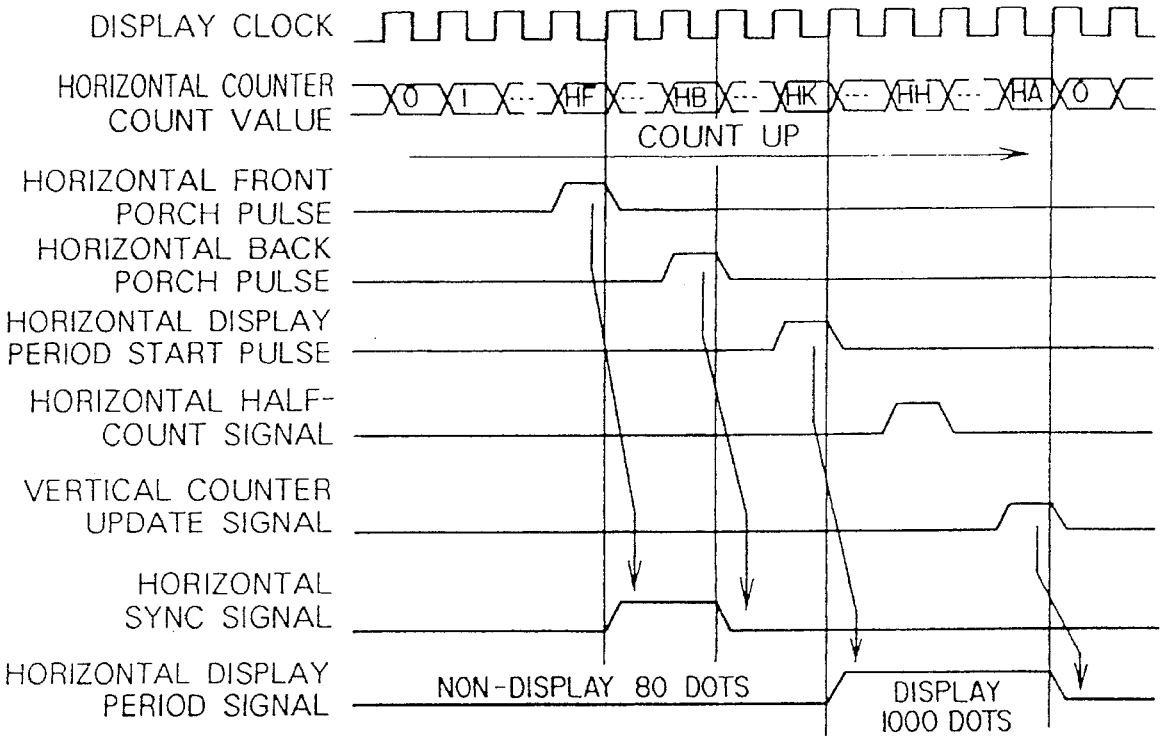
FIG. 6 is a timing chart for explaining a method of producing a horizontal sync signal and a horizontal display period signal.

In FIG. 6, the horizontal counter 1023 is constructed by an up counter and the setting of parameters for a horizontal direction for controlling a display device is made by setting the values of the horizontal counter 1023 at the time of rise of a horizontal sync signal, at the time of fall of the horizontal sync signal, at the time of start of a horizontal display period and at the time of end of the horizontal display period. In FIG. 6, those values to be set into a register are represented by H front porch value (HF), H back porch value (HB), H blanking value (HK) and H all value (HA). Also, H half value (HH) represents an integer part of (HA+1)/2 and is used for generating a timing for a vertical sync signal for a display device of an interface system.

Figure 7:
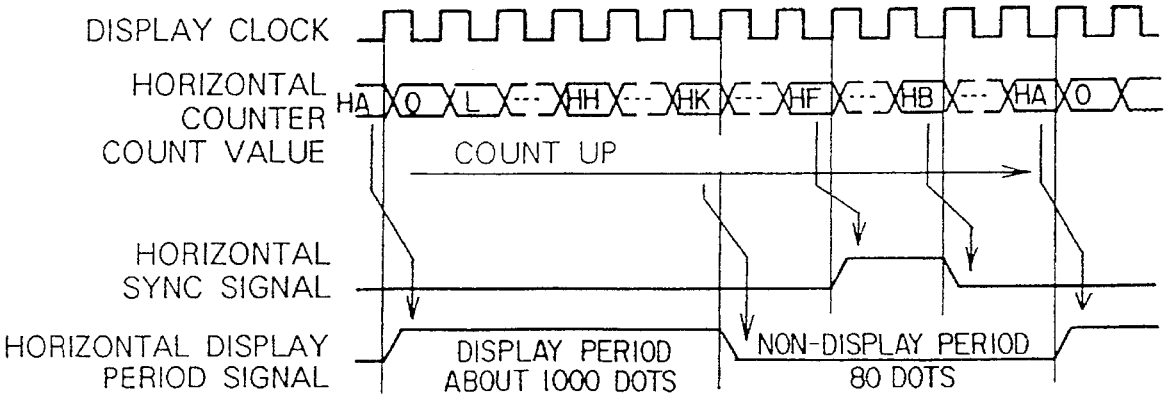
FIG. 7 is a timing chart for explaining an undesirable example of a method for controlling the horizontal counter.

When only the use of the value 1041 of the horizontal counter as a part of an address for reading display data is taken into consideration, a method shown in FIG. 7 may be considered as a method controlling the horizontal counter 1023. On the other hand, in the case where the setting of the rise and fall timings of the horizontal sync signal 120 is made by a method in which the values of the horizontal counter at the rise and fall timings are set into a register of the display control LSI, the hardware can be simplified. However, when such a setting method is used in the control method shown in FIG. 7, there is a problem that the number of register bits to be set is increased since those timings are concentrated in a horizontal non-display period.

In the case where the image memory is constructed by a dual-port image memory, the control method using the waveform (a3) or (b1) shown in FIG. 5 is excellent in that the number of bits required for a register is less and the control can be simplified.

There can exist various methods for controlling the vertical counter 1025 the number of which may be the same as the number of the methods for controlling of the horizontal counter 1023. However, an address for reading display data is necessary both in the case where the image memory is constructed by an ordinary dynamic or static memory and in the case where the image memory is constructed by a dual-port image memory.

Figure 8:
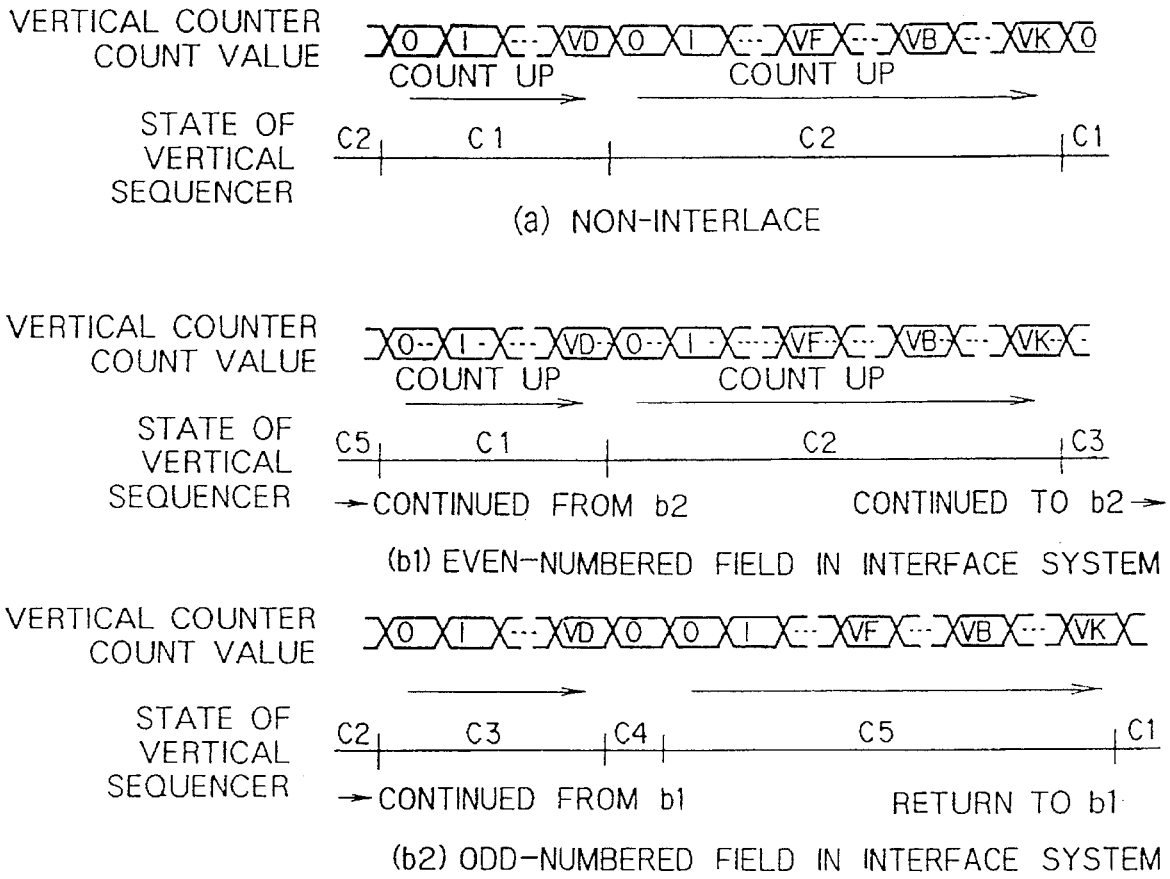
FIG. 8 shows timing charts for explaining methods for controlling a vertical counter.

FIG. 8 shows a method for controlling the vertical counter 1025.

In order to use the value 1140 of the vertical counter 1025 as an address for reading of display data, the vertical counter 1025 is controlled such that the count value 1140 takes 0 at the lead of a vertical display period and is incremented at every one horizontal period. In the case where a display device of an interface system is to be controlled, the control should be made such that an interval from a display period of an even-numbered field to a display period of an odd-numbered field is made longer than that from a display period of an odd-numbered field to a display period of an even-numbered field by one horizontal period.

When the use of the vertical counter value 1140 as the display data read address is taken into consideration, a method shown in FIG. 8 is used as a method for controlling the vertical counter 1025. Such control can be realized in such a manner that a vertical sequencer for controlling conditions for one display image is provided in the vertical counter control circuit 1026 to repeat states C1 and C2 in the case of a non-interface system and to repeat states C1 to C5 in the case of an interface system, as shown in FIG. 8.

As mentioned above, in the case where the image memory is constructed by a dual-port image memory, it is possible to use the value 1140 of the vertical counter as a read transfer address of the dual-port image memory. Also, in the case where the image memory is constructed by an ordinary static or dynamic memory, it is possible to use the value 1041 of the horizontal counter and the value 1140 of the vertical counter. Accordingly, it is not necessary to provide an address counter. As a result, the amount of logic can be reduced.

Figure 10:
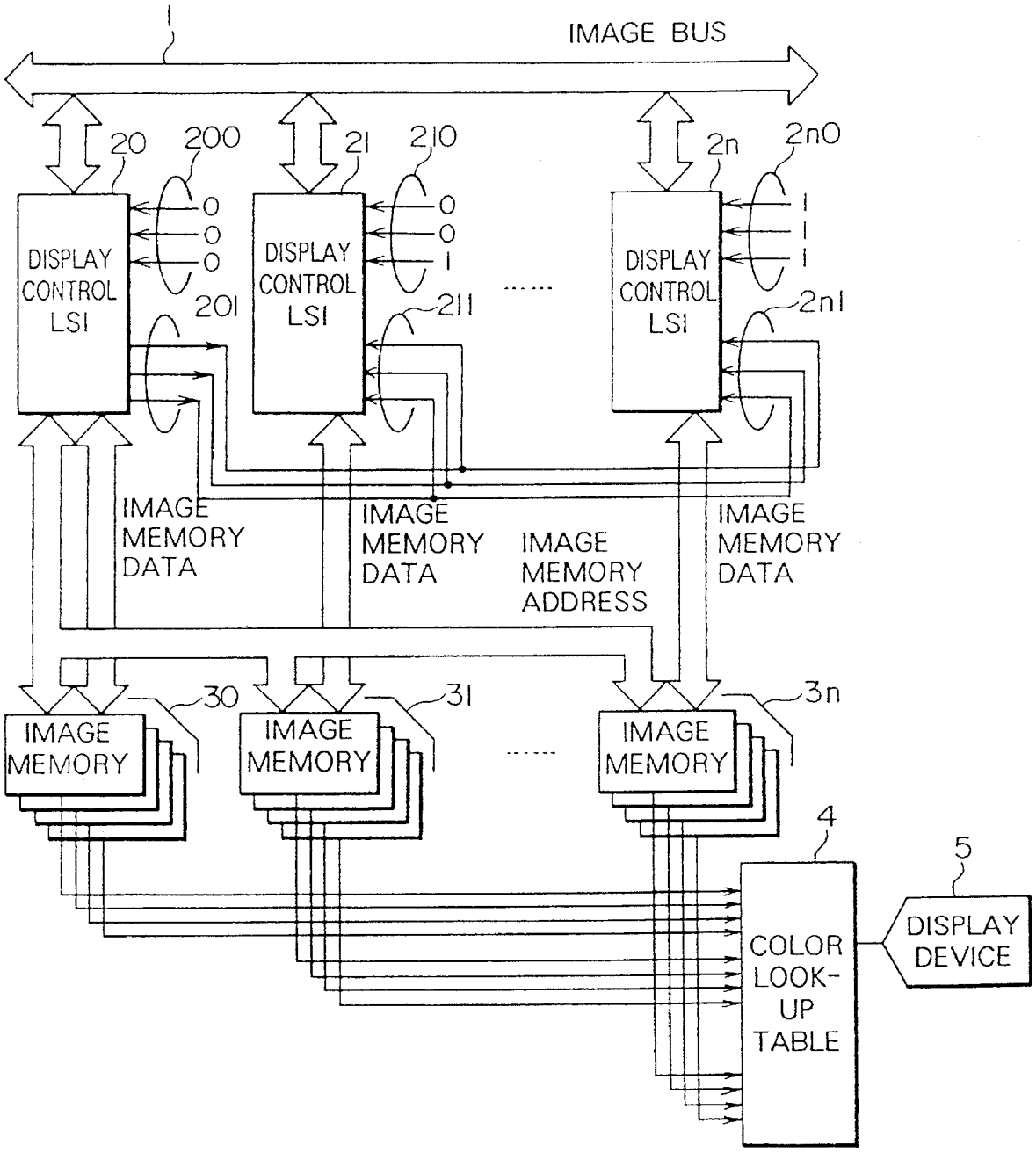
FIG. 10 is a block diagram showing a specified example of the construction of an image display board according to the present invention.

Since display control LSI's operate in synchronism with each other, a construction, as shown in FIG. 10, in which only one display control LSI 20 to enable the inter-LSI sync signals 2010, 2011 and 2012 outputs an address, can be employed though there may be employed a construction in which each display control LSI uses the value 1041 of its own horizontal counter or the value 1041 of its own horizontal counter and the value 1140 of its own vertical counter as a read transfer address of a dual-port image memory or an address for read from an ordinary port of an ordinary static or dynamic memory.

In an image display board shown in FIG. 10, an image memory address transfer bus is connected only between a display control LSI 20 and image memories 30, 31, . . . and 3*n*, and image memory data transfer buses are between the display control LSI's 20, 21, . . . and 2*n* and the image memories 30, 31, . . . and 3*n*, respectively. With this construction, it is possible to reduce the number of wirings in the display board for the address bus.

Next, a method of synchronizing the display device control units of the plurality of the display control LSI's with each other will be explained returning to FIG. 4.

In FIG. 4, a frame sync signal 2010 and a read transfer sync signal 2011 are signals for synchronizing the display device control units 102 with each other. A description is first made of the frame sync signal 2010. At the timing of rise of the next display clock 6 after the frame sync signal 2010 has been output, the horizontal counter 1023, the horizontal counter control circuit 1024, the vertical counter 1025 and the vertical counter control circuit 1026 return to their conditions at the head of a field in the case of a non-interface system and to their conditions at the head of a frame in the case of an interface system. When the start bit 1020 of the display device control unit 102 is in a disabled condition, the frame sync signal 2010 is always output by an OR gate 1022 so that the horizontal counter 1023, the horizontal counter control circuit 1024, the vertical counter 1025 and the vertical counter control circuit 1026 are fixed to their conditions at the lead of a field in the case of the non-interface system and to their conditions at the head of a frame in the case of the interface system.

A buffer 106 of a specified one of the plurality of display control LSI's is enabled to output the frame sync signal 2010. This frame sync signal is received by all the display control LSI's inclusive of the enabling display control LSI. The received signal is input as a frame initializing signal 20101 into the horizontal counter control circuit 1024 and the vertical counter control circuit 1026.

The following will show two reasons why the frame sync signal 2010 generated by the one display control LSI is used by all of the display control LSI's.

A first reason is as follows. Though the plurality of display control LSI's having the same construction are different in fixed values to be set to input pins 200, 210, . . . and 2n0 for recognizing or identifying I/O information, the write into the corresponding registers of all the display control LSI's is made simultaneously. Therefore, the start bits 1020 of the individual display control LSI's are also changed simultaneously. However, if the synchronization is independently made in the individual display control LSI's, there is a possibility that a deviation in the start bits 1020 may occur between the display control LSI's. Accordingly, it is required that a signal synchronized in one display control LSI should be used by all the display control LSI's.

A second reason is that since the individual display control LSI's operate independently of each other, the recovery of synchronization must be made even if a deviation from synchronization between circuits for making the control of the display device occurs due to external noises such as power source noises, electric waves, alpha rays or the like.

Even in the case where a deviation from synchronization occurs between the individual display control LSI's, the synchronization between the display device control units 102 of all the display control LSI's is obtained when the one display control LSI having output the frame sync signal 2010 returns to a condition at the lead of a frame. The second reason holds even for the case where the display clock signal 6 and the image clock signal 7 are synchronous with each other.

As mentioned above, the frame sync signal 2010 brings the display device control units of all the display control LSI's into their conditions at the lead of a frame. Therefore, even in the case where a deviation from frame synchronization occurs between the display device control units of the plurality of display control LSI's due to noises, the recovery of synchronization can be made in one frame.

Also, the display device control unit 102 is fixed to a condition at the lead of a frame prior to activation of the display device control unit 102 by continuing the assertion of the frame sync signal 2010 and is activated by negating the frame sync signal 2010 in synchronism with the display clock signal 6. Therefore, even in the case where the activation is made in synchronism with the image clock signal 7, it is possible to activate all the display device control units 102 simultaneously in synchronism with the display clock signal 6.

Next, an explanation will be made of the read transfer sync signal 2011, or the method for synchronization of a read transfer cycle between the display control LSI's in the case where the image memory is constructed by a dual-port image memory.

A signal 1050 in FIG. 4 is a signal which is produced from the horizontal counter control circuit 1024 and the vertical counter control circuit 1026 and from which a read transfer request signal 112 originates. The signal 1050 is synchronous with the display clock signal 6. In the case where the display clock signal 6 and the image clock signal 7 are asynchronous, the signal 1050 is supplied to a synchronizing circuit 1029 to obtain a signal synchronized with the image clock signal 7. From this synchronized signal 1050 and a version of the signal 1050 delayed by one clock in terms of the image clock signal 7, the synchronizing circuit 1029 generates a signal 20110 which is asserted only during the period of one clock in terms of the image clock signal 7.

In the case where the display clock signal 6 and the image clock signal 7 are synchronous with each other, the synchronizing circuit 1029 is unnecessary and a signal 20110 asserted during only the period of one clock in terms of the image clock signal 7 is generated from the signal 1050 and a version thereof delayed by one clock in terms of the image clock signal 7.

The signal 20110 is a signal which provides the timing of generation of a read transfer request signal 112. The signal 20110 is enabled as a read transfer sync signal 2011 by one of the plurality of display control LSI's. This read transfer sync signal 2011 is received by all the display control LSI's inclusive of the enabling display control LSI. A read transfer request generation circuit 1030 generates a read transfer request signal 112 from the received read transfer sync signal 2011. For two reasons to be explained, it is also required, for the signal 20110 providing the timing of generation of the read transfer request signal 112, that the signal 20110 be enabled as the read transfer sync signal 2011 by one display control LSI and that the enabled signal be received and used by all of display control LSI's inclusive of the enabling display control LSI.

A first reason is as follows. Since the display device control units 102 of all the display control LSI's operate in synchronism with each other, the signal 1050, from which the read transfer request signal 112 originates, is changed simultaneously in all the display control LSI's. However, if the synchronization is made independently in the individual display control LSI's, there is a possibility that a deviation in change of the signal 1050 may occur between the display control LSI's. Therefore, it is required that a signal synchronized in one display control LSI should be used by all the display control LSI's.

A second reason is as follows. In the case where a deviation from synchronization occurs between the display device control units 102 of the individual display control LSI's due to external noises, the recovery of synchronization by the frame sync signal 2010 is made at the lead of the next frame. However, there may exist read transfer cycles the maximum number of which is equal to the number of display lines of one image. Therefore, there is a possibility that the read transfer cycle deviates between the individual display control LSI's before the recovery of synchronization is made.

Since the read transfer sync signal 2011 generated by the one display control LSI is used by all the display control LSI's, the timing of the read transfer cycle of each display control LSI is determined by the operation of the display device control unit 102 of the display control LSI which has output the read transfer sync signal 2011. The second reason holds even the case where the display clock signal 6 and the image clock signal 7 are synchronous with each other.

In the case where the display clock signal 6 and the image clock signal 7 are synchronous with each other, a ground for the need of the read transfer sync signal 2011 is only the second reason. If the influence of noises is very small and the reliability of the system can be ensured, the second reason becomes extinct, that is, the read transfer sync signal 2011 can be omitted in such a manner that the timing for read transfer is generated by each display control LSI.

As mentioned above, the read transfer sync signal 2011 is used such that a signal synchronized in one display control LSI is used by all of display control LSI's. Therefore, it is possible to cause the read transfer at the same timing even in the case where the display clock signal 6 and the image clock signal 7 are asynchronous. Also, even in the case where a deviation from frame synchronization occurs between the display device control units 102, there is no concern that the timing for read transfer deviates.

In the case where the image memory is constructed by an ordinary dynamic or static memory, a signal for activation of the cycle of read of display data from an ordinary port of the image memory is output in lieu of the read transfer sync signal 2011 by one display control LSI and it is used by all the display control LSI's. In this case, the read cycle for display must be made in synchronism with the display clock signal 6 during a period of time when the display is made. Therefore, it is required that the display clock signal 6 and the image clock signal 7 are synchronous with each other.

Next, the construction of the refresh activation unit 105 will be explained by use of FIG. 9.

When the image memory is constructed by an ordinary dynamic memory or a dual-port image memory, it is necessary to refresh the image memory periodically in order to preserve the storage contents of the memory.

Figure 9:
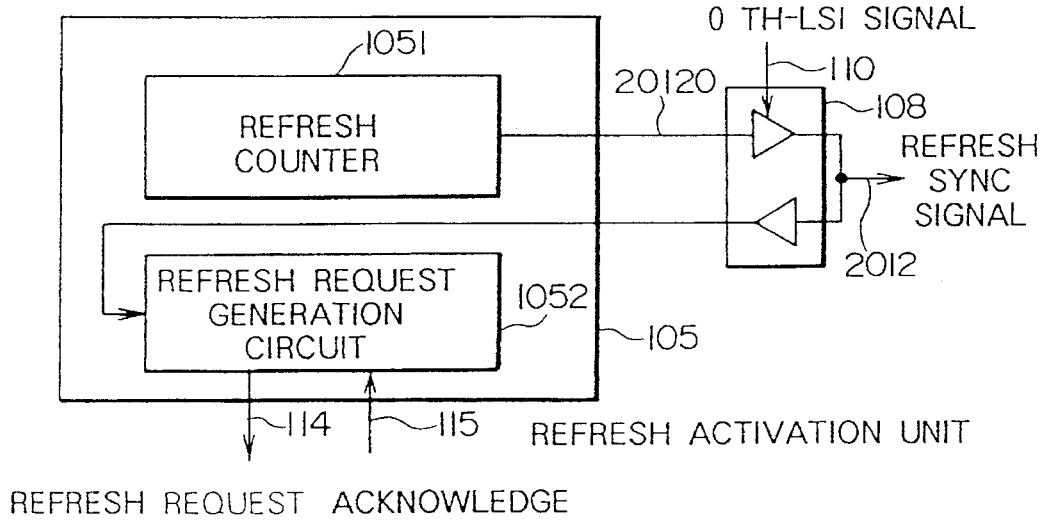
FIG. 9 is a circuit diagram showing the construction of a refresh activation unit.

In FIG. 9, a refresh counter 1051 is a counter which is counted up automatically following the turn-on of a power each time one clock of the image clock signal 7 is input and returns to 0 when all bits of the counter take "1". . . Each time the count value becomes 0, the refresh counter 1050 outputs a signal 20120 which provides the timing of generation of a refresh request signal 114. The signal 20120 is enabled as a refresh sync signal 2012 by one of a plurality of display control LSI's and this refresh sync signal 2012 is received by all the display control LSI's inclusive of the enabling display control LSI.

On the basis of the received refresh sync signal 2012, a refresh request generation circuit 1052 generates a refresh request signal 114.

For one reason as will be explained, it is also required, for the signal 20120 providing the timing of generation of the refresh request signal 114, that the signal 20120 be enabled as the refresh sync signal 2012 by one display control LSI and that the enabled signal be used by all of the display control LSI's inclusive of the enabling display control LSI.

The reason is as follows. Since the refresh counters 1051 of the individual display control LSI's operate independently from each other, a deviation from synchronization of the refresh cycle occurs between the individual display control LSI's in the case where a deviation from synchronization of the refresh counter 1051 occurs due to external noises. However, if a refresh sync signal 2012 generated by one display control LSI is used by all of display control units, the timing of the refresh cycle of all the display control LSI's can be determined by the operation of the refresh counter 1051 of the display control LSI which has output the refresh sync signal 2012.

The above reason holds even for the case where the display clock signal 6 and the image clock signal 7 are synchronous with each other.

As mentioned above, the refresh sync signal 2012 is used such that a signal synchronized in one display control LSI is used by all of the display control LSI's. Therefore, even in the case where a deviation from synchronization occurs between the refresh activation units 105 of the plurality of the display control LSI's, there is no concern that the timing for refreshment deviates.

As has been explained in the foregoing, according to the present embodiment, only one of a plurality of display control LSI's distinguished from the others enables inter-LSI sync signals 2010, 2011 and 2012 and the enabled inter-LSI sync signals are used by all the display control LSI's inclusive of the enabling display control LSI. Therefore, even in the case where the display clock signal 6 and the image clock signal 7 are asynchronous, all of the display control LSI's operate in synchronism with the inter-LSI sync signal, thereby making it possible to produce data to be simultaneously displayed on one display device.

Also, since all of the display control LSI's have the same construction, it is possible to provide a display control system in which the number of bits forming one pixel can be changed in such a manner that the number of display control LSI's excepting a display control LSI to enable an inter-LSI sync signal is merely changed with no change in construction.

Many different embodiments of the present invention may be constructed without departing from the spirit and scope of the invention. It should be understood that the present invention is not limited to the specific embodiments described in this specification. To the contrary, the present invention is intended to cover various modifications and equivalent arrangements included within the spirit and scope of the claims.

What is claimed:

1. A display control system coupled to a computer for generating synchronizing signals to control plane groups of a display device, each of said plane groups includes color planes of the same image data, said computer outputs display information consisting of image data and stores said image data in a plurality of frame memories having said planes, said display control system comprising:

a plurality of display control means provided for controlling said plane groups, respectively;

interconnecting means for transmitting at least one kind of synchronization signal for synchronizing said plurality of display control means with each other;

each of said plurality of display control means including signal generating means for generating said at least one kind of synchronization signal and specifying means for generating a specifying signal distinguishing a designated display control means from other of said display control means in response to a selective designation of one of said plurality of display control means, and input control means and output control means including an input circuit and an output circuit connected to said interconnecting means, for receiving and outputting a synchronization signal respectively, said output circuit being enabled in accordance with said specifying signal;

said interconnecting means connecting said input control means and said output control means, wherein, in response to said specifying signal, said output circuit of said designated display control means is enabled to output at least a synchronization signal generated by said signal generating means to said interconnecting means, and said input circuits of all of said plurality of display control means being connected to said interconnecting means to receive said output synchronization signal from said designated display control means, whereby all of said display control means operate in synchronism with each other according to said output synchronization signal.

2. A display control system coupled to a computer for controlling a display device, said computer outputs display information consisting of image data and stores said image data in a plurality of frame memories having planes on said display device, the display control system comprising:

a plurality of display control means for controlling respective plane groups, each including color planes of the same image data, in which each of said plurality of display control means includes signal generating means for generating at least one kind of synchronization signal, specifying means for generating a specifying signal distinguishing a designated display control means from others of said display control means in response to a selective designation of one of said plurality of display control means, and output means for outputting at least one kind of synchronization signal for operating said plurality of display control means in synchronism with each other and input means receiving information indicative of a selective distinction of one of said plurality of display control means from other of said display control means, said input means and said output means of said plurality of control means are correspondingly inter-connected by a bus, wherein in response to said specifying signal, said output means of said designated display control means is enabled to output at least a synchronization signal generated by said signal generating means to said interconnecting means, said output means of said distinguished display control means enables and outputs said synchronization signal, and said plurality of display control means inclusive of the distinguished display control means receives the enabled synchronization signal from respective input means and operate in synchronism according to said enabled synchronization signal received from the output means of said distinguished display control means, wherein each of said plurality of frame memories is constructed by a dual-port image memory, and said synchronization signal includes at least a frame synchronization signal for bringing a control condition of said display device into a condition at the head of a frame, a read transfer synchronization signal for providing the basis of the timing of generation of a read transfer cycle of said dual-port image memory and a refresh synchronization signal for providing the basis of the timing of generation of a refresh cycle of said dual-port image memory.

3. A display control system according to claim 2, wherein said display control means includes means for generating said frame synchronization signal producing a logical sum of an inverted version of a signal which is input from the bus connected to the display control system to enable operation of the display device and to enable the timing of activation of the control of said display device and a signal which indicates one clock period of the final frame of said display device.

4. A display control system according to claim 2, wherein a display clock signal which provides the basis of the timing control of said display device and an image clock signal, the display clock signal and the image clock signal being asynchronous, are connected from the bus to the display control system and provide the basis of the timing control of said image memory, said display control means includes means for causing the read transfer synchronization signal synchronous with said display clock signal to be synchronized with said image clock signal.

5. A display control system according to claim 2, wherein a display clock signal which provides the basis of the timing of control of said display device and an image clock signal, the display clock signal and the image clock signal being asynchronous, are connected to the display control system and provides the basis of the timing of control of said image memory, said display control means includes means for generating said frame synchronization signal by synchronizing a signal input from said bus in synchronism with said image clock signal and provides the basis of the timing of activation of the control of said display device with said display clock signal and producing a logical sum of an inverted version of said synchronized signal and a signal indicative of the last clock period of the frame of said display device.

6. A display control system according to claim 2, wherein each of said frame memories is constructed by at least one dual-port image memory, and each of said plurality of display control means includes counter means for generating timing for a vertical display period signal and a vertical synchronization signal to control said display device, so that count values of said counter means representative of the timing are provided as an address for read transfer cycle of said dual-port image memory.

7. A display control system according to claim 2, wherein said frame memory is constructed by a static or dynamic memory, and said display control means includes a first counter for generating timing for a vertical display period signal and a vertical synchronization signal to control said display device and a second counter for generating timing for a horizontal display period signal and a horizontal synchronization signal to control said display device, so that count values of said first and second counters representative of the timing are provided as an address for read for displaying data written in said static or dynamic memory.

8. A display control system coupled to a computer for controlling a display device, said computer outputs display information consisting of image data and stores said image data in a plurality of frame memories having planes on said display device, the display control system comprising:

a plurality of display control means for controlling respective plane groups, each including color planes of the same image data, in which each of said plurality of display control means includes signal generating means for generating at least one kind of synchronization signal, specifying means for generating a specifying signal distinguishing a designated display control means from others of said display control means in response to a selective designation of one of said plurality of display control means, and output means for outputting at least one kind of synchronization signal for operating said plurality of display control means in synchronism with each other and input means receiving information indicative of a selective distinction of one of said plurality of display control means from other of said display control means, said input means and said output means of said plurality of control means are correspondingly inter-connected by a bus, wherein in response to said specifying signal, said output means of said designated display control means is enabled to output at least a synchronization signal generated by said signal generating means to said interconnecting means, said output means of said distinguished display control means enables and outputs said synchronization signal, and said plurality of display control means inclusive of the distinguished display control means receives the enabled synchronization signal from respective input means and operate in synchronism according to said enabled synchronization signal received from the output means of said distinguished display control means, wherein said frame memory comprises a dynamic memory, and said synchronization signal includes at least a frame synchronization signal for bringing a control condition of said display device into a condition at the head of a frame, a data read synchronization signal for providing the basis of the timing of reading of data from said dynamic memory, and a refresh synchronization signal for providing the basis of the timing of generation of a refresh cycle of said dynamic memory.

9. A display control system coupled to a computer for controlling a display device, said computer outputs display information consisting of image data and stores said image data in a plurality of frame memories having planes on said display device, the display control system comprising:

a plurality of display control means for controlling respective plane groups, each including color planes of the same image data, in which each of said plurality of display control means includes signal generating means for generating at least one kind of synchronization signal, specifying means for generating a specifying signal distinguishing a designated display control means from others of said display control means in response to a selective designation of one of said plurality of display control means, and output means for outputting, respectively, at least one kind of synchronization signal for operating said plurality of display control means in synchronism with each other and input means receiving information indicative of a selective distinction of one of said plurality of display control means from other of said display control means, said input means and said output means of said plurality of control means are correspondingly inter-connected by a bus, wherein in response to said specifying signal, said output moans of said designated display control means is enabled to output at least a synchronization signal generated by said signal generating means to said interconnecting means, said output means of said distinguished display control means enables and outputs said synchronization signal, and said plurality of display control means inclusive of the distinguished display control means receives the enabled synchronization signal from respective input means and operate in synchronism according to said enabled synchronization signal received from the output means of said distinguished display control means, wherein said frame memory comprises a static memory, and said synchronization signal includes at least a frame synchronization signal for bringing a control condition of said display device into a control condition at the head of a frame and a data read synchronization signal for providing the basis of the timing of reading of data from said static memory.

* * * * *